US009146083B2

(12) United States Patent
Lamothe

(10) Patent No.: US 9,146,083 B2
(45) Date of Patent: Sep. 29, 2015

(54) PROJECTILE CONTAINMENT SYSTEM

(71) Applicant: Bullet Trap, LLC, Burlington, CT (US)

(72) Inventor: Richard P. Lamothe, Burlington, CT (US)

(73) Assignee: Bullet Trap USA, LLC, Burlington, CT (US)

( * ) Notice: Subject to any disclaimer, the term of this patent is extended or adjusted under 35 U.S.C. 154(b) by 88 days.

(21) Appl. No.: 13/951,864

(22) Filed: Jul. 26, 2013

(65) Prior Publication Data

US 2015/0028546 A1 Jan. 29, 2015

Related U.S. Application Data

(63) Continuation-in-part of application No. 13/475,511, filed on May 18, 2012, now Pat. No. 8,827,274.

(51) Int. Cl.
*F41J 13/00* (2009.01)

(52) U.S. Cl.
CPC ..... *F41J 13/00* (2013.01)

(58) Field of Classification Search
USPC ..... 273/403–410
See application file for complete search history.

(56) References Cited

U.S. PATENT DOCUMENTS 4,821,620 A * 4/1989 Cartee et al. ..... 273/410
5,040,802 A * 8/1991 Wojcinski et al. ..... 273/410
5,400,692 A * 3/1995 Bateman ..... 273/410
5,456,155 A * 10/1995 Myrtoglou ..... 273/410
5,486,008 A * 1/1996 Coburn ..... 273/410
5,535,662 A * 7/1996 Bateman ..... 273/410
5,718,434 A * 2/1998 Alward ..... 273/410
5,749,177 A * 5/1998 Pontus et al. ..... 52/79.1
5,822,936 A * 10/1998 Bateman ..... 52/281
7,275,748 B2 * 10/2007 Lambert et al. ..... 273/410
8,128,094 B2 * 3/2012 Bateman et al. ..... 273/410
8,602,418 B1 * 12/2013 Hering et al. ..... 273/410
8,827,274 B2 * 9/2014 Lamothe ..... 273/410
2007/0102883 A1 * 5/2007 Parks et al. ..... 273/348
2012/0126480 A1 * 5/2012 Bassett et al. ..... 273/410

* cited by examiner

*Primary Examiner* — Mark Graham
(74) *Attorney, Agent, or Firm* — McCormick, Paulding & Huber LLP

(57) ABSTRACT

Converging hardened steel plates are loosely mounted in a frame, with neoprene pads between them to better absorb the noise and impact from projectiles. The upstream end of the bullet trap is a target area, and a containment chamber communicates with the downstream ends of the plates defines a throat area. A transition area connects the chamber entry with the throat area. An impact plate between them has end portions fitted loosely in openings defined by the support frame. A plurality of vanes define the cylindrical chamber, and have loosely supported ends. These vanes have edges that abut and over-lap one another so movement of adjacent vanes will occur in response to one of these vanes being struck by a projectile. These vanes are normally restrained but can move radially outwardly when hit by a projectile. The number of vanes is less than 20 degrees in the chamber.

10 Claims, 7 Drawing Sheets

PROJECTILE CONTAINMENT SYSTEM

CROSS REFERENCE TO RELATED APPLICATIONS

This application incorporates by reference U.S. patent application Ser. No. 13/475,511 filed May 18, 2012, now issued U.S. Pat. No. 8,827,274, and claims priority thereto in so far as common subject matter/invention is included.

FIELD OF INVENTION

This invention relates to projectile containment systems such as might be required at firing ranges or the like, and deals more particularly with a bullet trap of the type having an open front end in which a target can be provided, and a steel structure for decelerating these projectiles and containing the projectiles fired at that target by a shooter located at a station some distance from the target. Such bullet traps are generally made from steel plates that are welded or bolted together in a structure that can include converging hardened steel plates defining a convergent passageway that directs the projectiles from the target area toward a projectiles containment chamber where they are collected for disposal.

PRIOR ART

Bullet traps of such steel plate construction are available from Megitt Training Systems of Suwanee Ga., and from Action Target of Provo, Utah. These bullet traps typically have upper and lower converging steel plates that direct the projectiles into an impact area so arranged as to abruptly decelerate the projectiles and contain them in a chamber. This chamber can be of generally semi-cylindrical shape, with a bottom opening and a tray for reclaiming the lead and other spent materials. U.S. Pat. No. 7,793,937 shows a trap of this variety, wherein a semi-cylindrical impact area of the chamber defined by replaceable hardened steel strips that are fixedly supported on flanges in the frame structure. One major disadvantage of this design is the very rigidity of the steel structure itself. Hardened steel, such as AR500 for example, tends to wear away, and become pitted, by the impact of the lead projectiles, leading to the need for replacement of the hardened steel strips. AR500 steel is not readily welded or machined by conventional heat generating fabrication processes, and poses a definite disadvantage to building and maintaining these prior art designs.

Thus, there is a need for improving upon both the cost of building and maintaining the hardened steel components of such traps, particularly in reducing the downtime and the expense required for removing and replacing the hardened steel turning vanes or strips that form the arcuately shaped containment chamber.

The need for replacing the hardened steel components used in these bullet traps has lead to excessive costs in both initial purchase of such traps, and in the upkeep thereof. Hardened steel, such as AR500, is not readily welded or machined, hence anything that can be done to reduce the fabrication costs will result in savings to both the manufacturer, and to the user in the form of reduced repair and maintenance costs. Additionally, there is a need to reduce the footprint of the structure to render it useable in a confined environment such as in the basement of a private residence, or similar space. Finally, such an environment also requires a substantial reduction in the noise generated in a steel bullet trap. This goal is facilitated in the trap of my invention.

SUMMARY OF THE INVENTION

The very rigidity of the steel frame, and of the hardened steel components from which the trap components are made, particularly in the impact area, in which one or more angled hardened steel plates are serially arranged to slow projectiles. These plates are, therefore, subject to wearing. There is a need to minimize this excessive wearing away and pitting of the hardened steel that results from the projectiles repeatedly striking the impact area of the trap.

The present invention provides a hardened steel containment chamber capable of absorbing the energy and momentum of high velocity projectiles in an energy efficient way, and without the shock and noise characteristic of prior art bullet traps. An impact plate of hardened steel deflects the projectiles into a containment chamber defined by elongated projectile turning vanes, or strips, that are so mounted as to absorb the inertial impact of a projectile. These vanes have overlapping edges that interact with one another in a unique way. The vanes are not fixed in the static frame, but are instead resiliently mounted so as to more efficiently absorb projectile impact. Each hardened steel strip, or vane, is mounted in an oversize opening of the steel frame support structure. More particularly, projecting end portions of these vanes are received in openings of slightly greater depth than the thickness of the vane end portions. The vanes are mounted in overlapping relationship, such that their adjacent edges overlap, causing each vane to effect an adjacent vane when struck by a projectile. As a result, at least two vanes will move slightly in reaction to one vane being impacted. The impact of the projectiles on these vanes is thereby absorbed more efficiently. A resilient elastomeric blanket is provided around the outside of the containment chamber defining vanes, and the blanket is biased radially inwardly, holding the vanes against the inside edges of their respective openings. The vane edges are thus held in engagement with one another, at least in their rest or ready positions, and will be displaced slightly in their respective openings in reacting to the impact and momentum of the projectiles, efficiently absorbing the energy thereof. The vanes are also biased inwardly by tensionable straps surrounding the elastomeric blanket. Allowing the vanes to move upon impact also reduces damage to these hardened steel vanes. The biasing force is achieved by wrapping at least one tensionable band or strap at least around the impact area of the containment chamber.

Another advantage to this unique yieldable vane mounting design is the reduction in the ambient noise level. Reducing the impact forces, between the hardened steel vanes and the lead projectiles, leads to a very significant reduction in the ambient noise level. This is a very important result, where the noise can create severe environmental concerns, such as in any confined area.

In accordance with the preferred embodiment of the invention, a transition passageway is provided between the downstream end of the convergent projectile passageway described previously and the containment chamber. This transition passageway includes a first segment, that forms a continuation of the throat area defined at the downstream ends of the converging plates, plus a second segment in which a single angled impact plate deflects projectiles slightly for directing them into an inlet opening of the containment chamber. The containment chamber is preferably cylindrical in shape, and the axis is vertically oriented, rather than horizontal as in my prior filed application. This geometry minimizes the footprint of the bullet trap itself, and the spent projectiles are collected at the bottom end of the vertically oriented chamber for funneling the bullets and bullet fragments downwardly into a 5 gallon bucket or similar container. The noxious gasses generated in the chamber are vented to a filter through an opening in the top of the vertically oriented cylinder.

DETAILED DESCRIPTION OF PREFERRED EMBODIMENT

Figure 1:
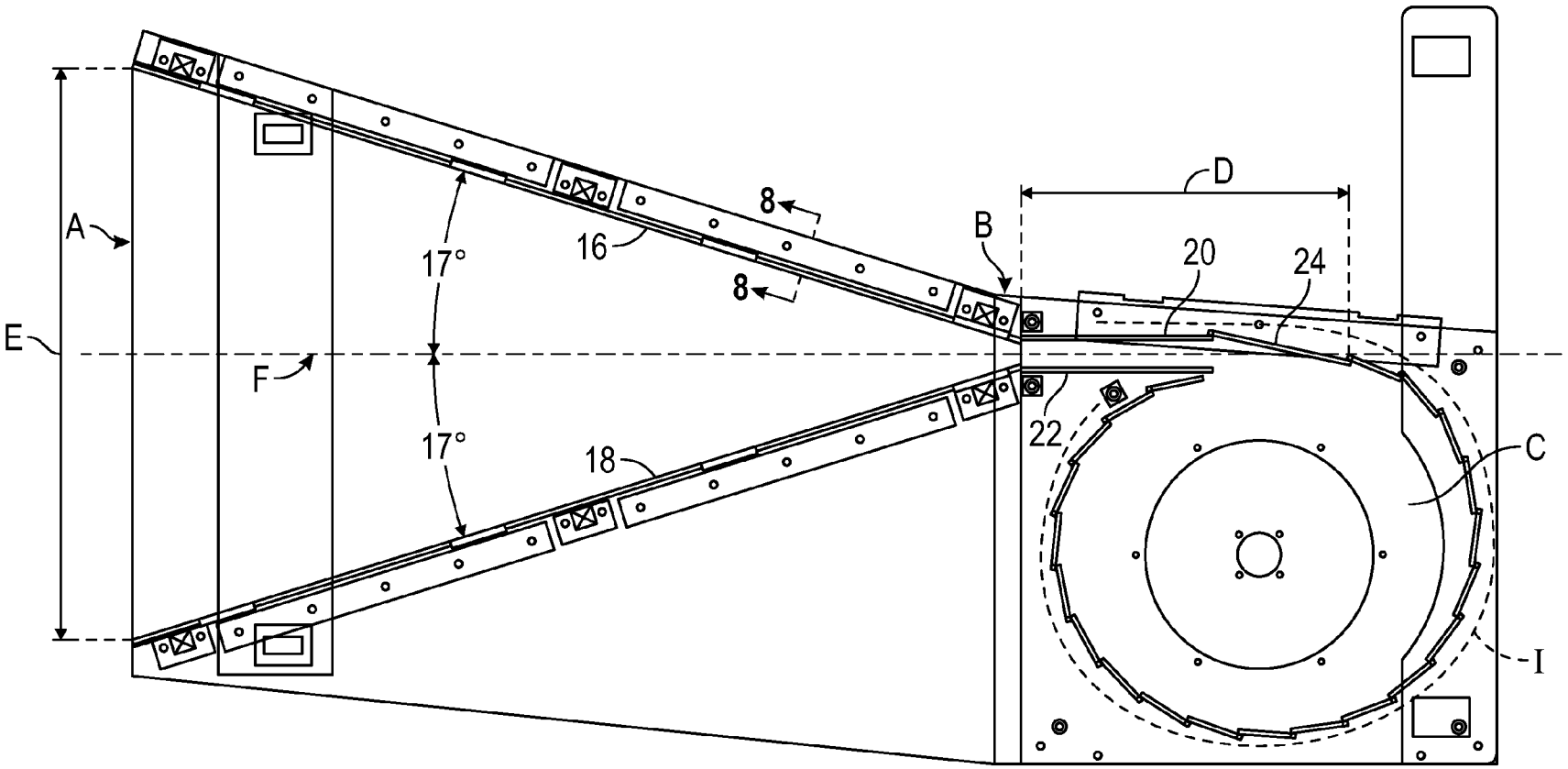
FIG. 1 is a top plan view of a bullet trap constructed in accordance with the present invention, with the upper top plate removed to better show the interior thereof.

In it's presently preferred form the bullet trap shown in the drawings will accommodate a single shooter located some distance upstream of the bullet trap. This distance will be dictated mostly by safety considerations, but will also be dictated by the type of firearm used, and by the immediate environment for the shooter's location relative to the bullet trap. The design is intended to minimize the foot print required, and the open/upstream end A, in which the target is mounted, is intended to be 25 feet from the shooter's station.

Figure 3:
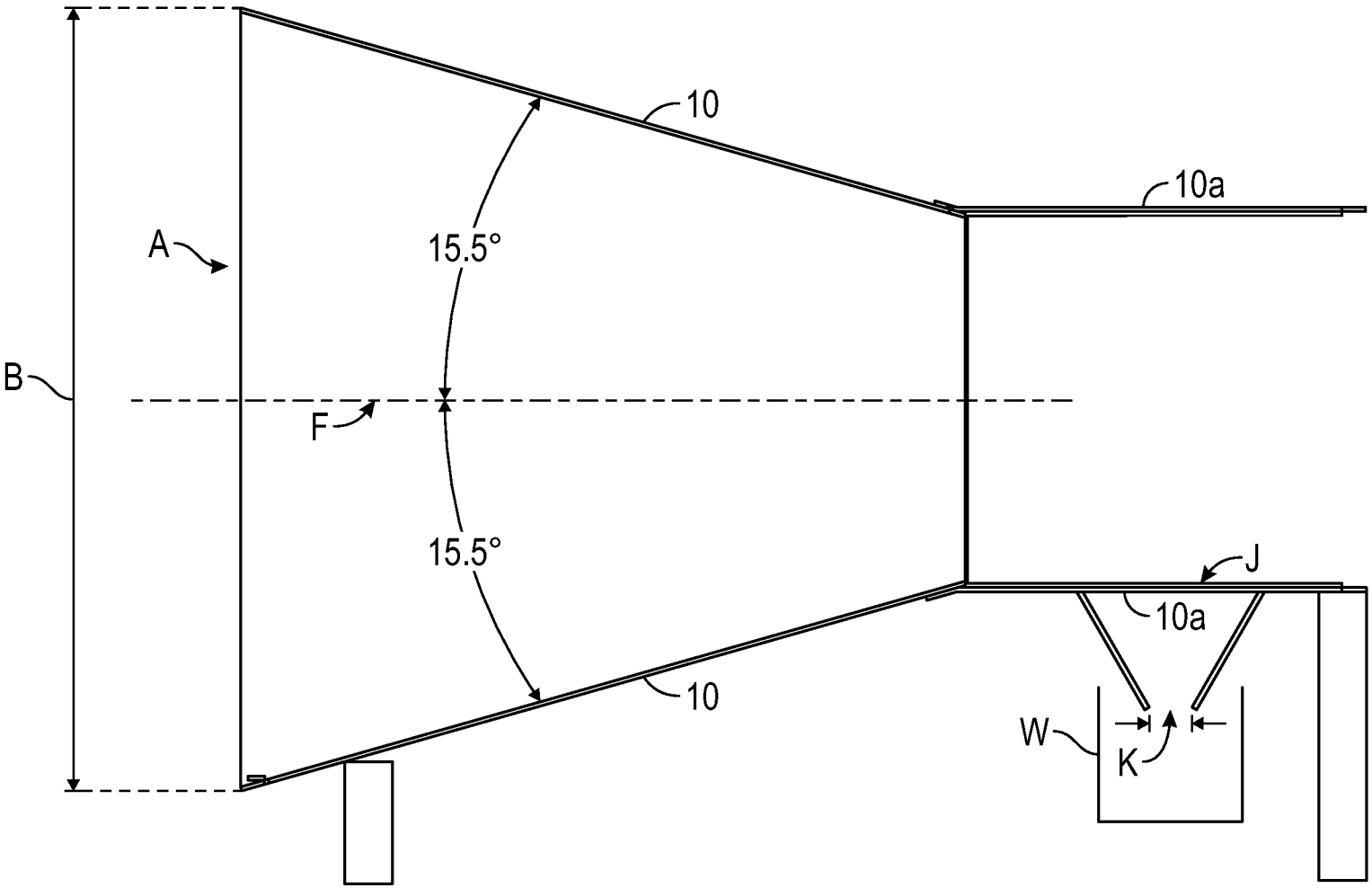
FIG. 3 is a side elevational view showing the angled top and bottom plates supported on legs and defining the fixed frame of the apparatus.
Figure 8:
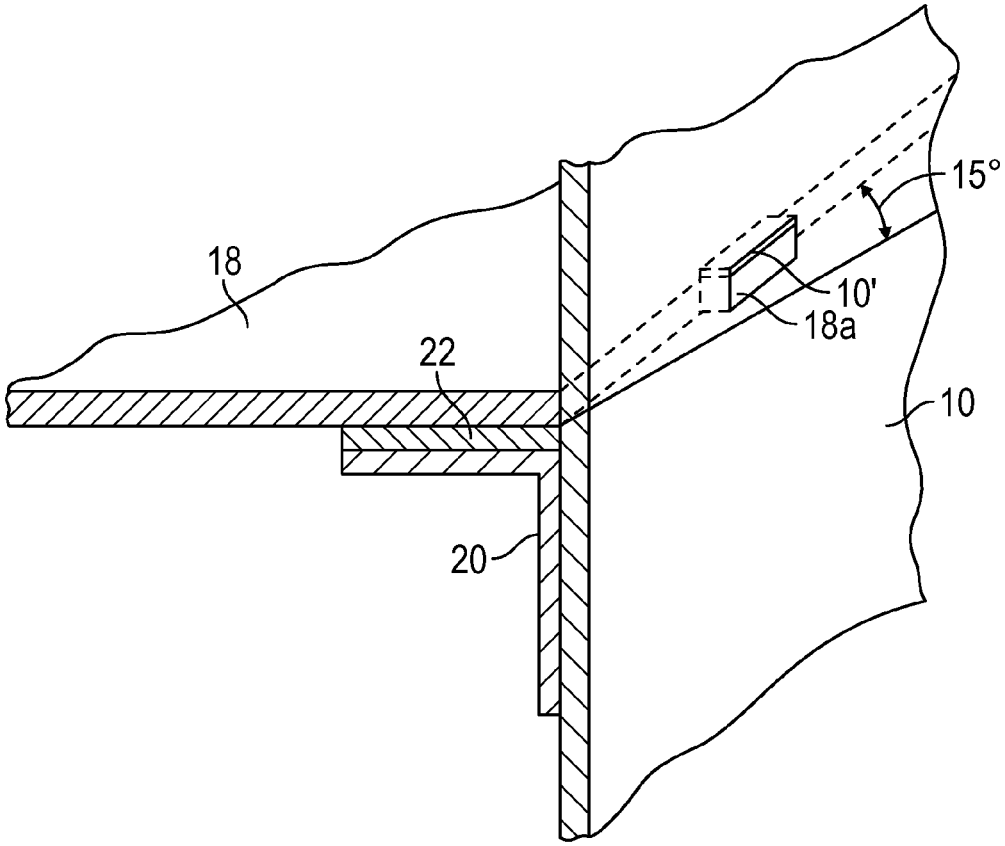
FIG. 8 is a sectional view taken on the lines 8-8 of FIG. 1.

The bullet trap of FIG. 1 has an open front end A, or target area of rectangular shape, into which the projectiles are fired by the shooter. As shown in FIGS. 1 and 3 the rectangularly shaped target opening A of the bullet trap has it's longer axis B oriented vertically (FIG. 3) and the shorter axis E oriented horizontally (FIG. 1). The top and bottom support plates 10,10, converge slightly (FIG. 3) and have angle iron support posts welded to or bolted to these fixed support plates. These support plates define over sized slots 10', 10' for receiving projecting tabs 18*a*, 18*a* integrally formed at spaced locations on the edges of the more steeply inclined hardened steel converging plates 16 and 18. See FIG. 8 from U.S. Pat. No. 8,827,274 for details on this mounting arrangement, wherein an elastomeric strip 22 is provided between each angle iron flange and these hardened steel plate tabs. This arrangement serves a twofold purpose; one to more efficiently absorb the impact of projectiles striking the hardened steel plates 16 and 18, and secondly to reduce significantly the noise created by such projectile/plate impact. These top and bottom plates 10,10 are angled toward one another at approximately 15 degrees with reference to the downstream direction so as to accommodate the projectiles fired into the bullet trap target opening A from the shooter's station, which is located upstream some distance from the bullet trap. Preferably, and as shown in FIG. 3 this angle is no more than about 15.5 degrees relative to the downstream direction. This allows non-hardened steel to be used for the frame defined by the steel support plates of the bullet trap.

The edges of the support plates 10,10 defining the target area A are preferably beveled inwardly to avoid deterioration due to bullets striking them, and holes 15,15 in provided in these support plates 10,10 are provided for receiving bungee cords, preferably of poly-urethane, to mount the paper target in the area A, Non-metallic "clothespins" may be used to clip the target to these cords.

The lateral sides of the rectangular target opening A are defined by forwardly facing vertical edges of the converging hardened steel plates, 16 and 18. These plates are preferably made from AR 500 steel, and may be oriented at more than the 15 degrees, an empirically determined limit referred to previously with reference to the non-hardened steel support plates 10,10.

Figure 2:
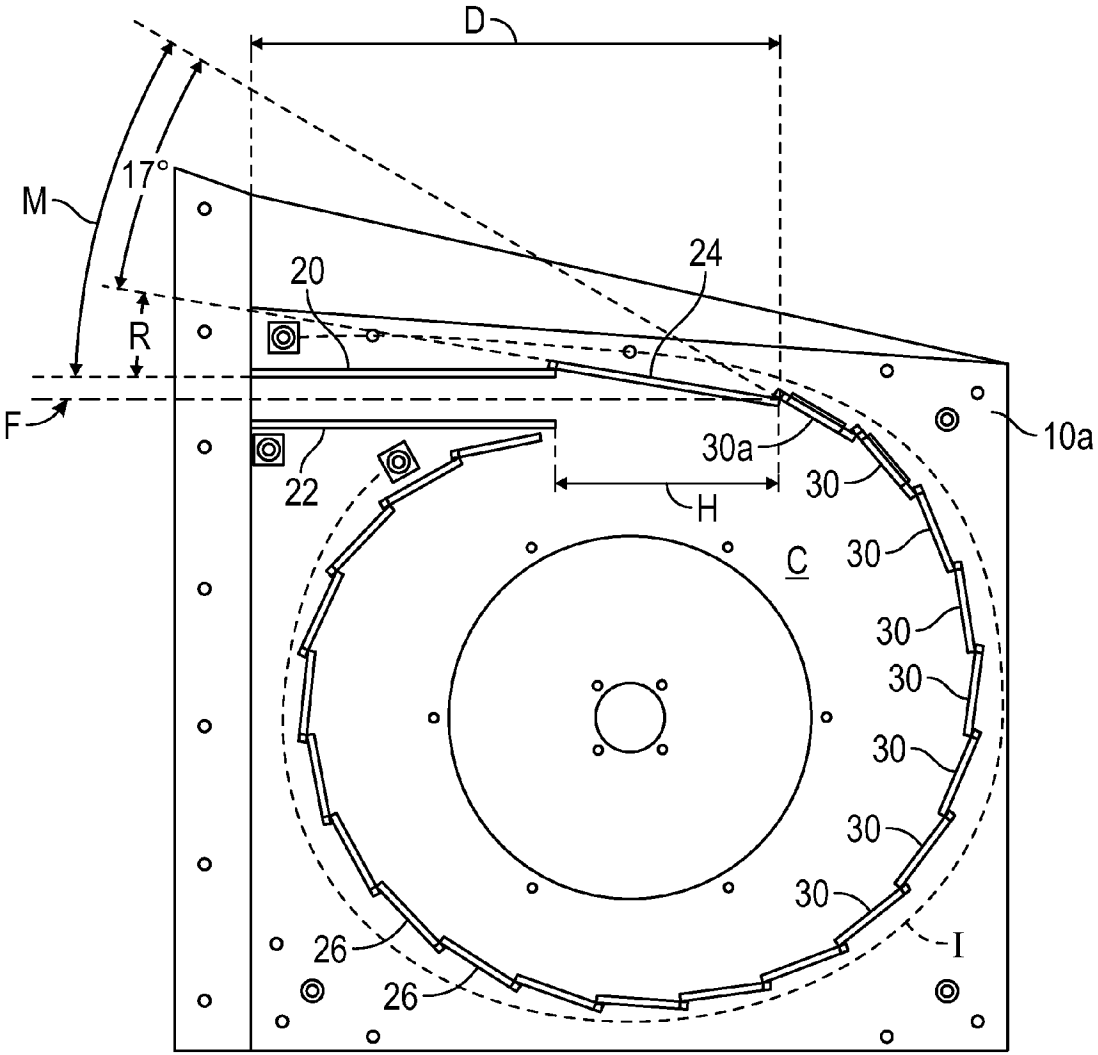
FIG. 2 is a horizontal sectional view showing the transition passageway and containment chamber in greater detail.
Figure 4:
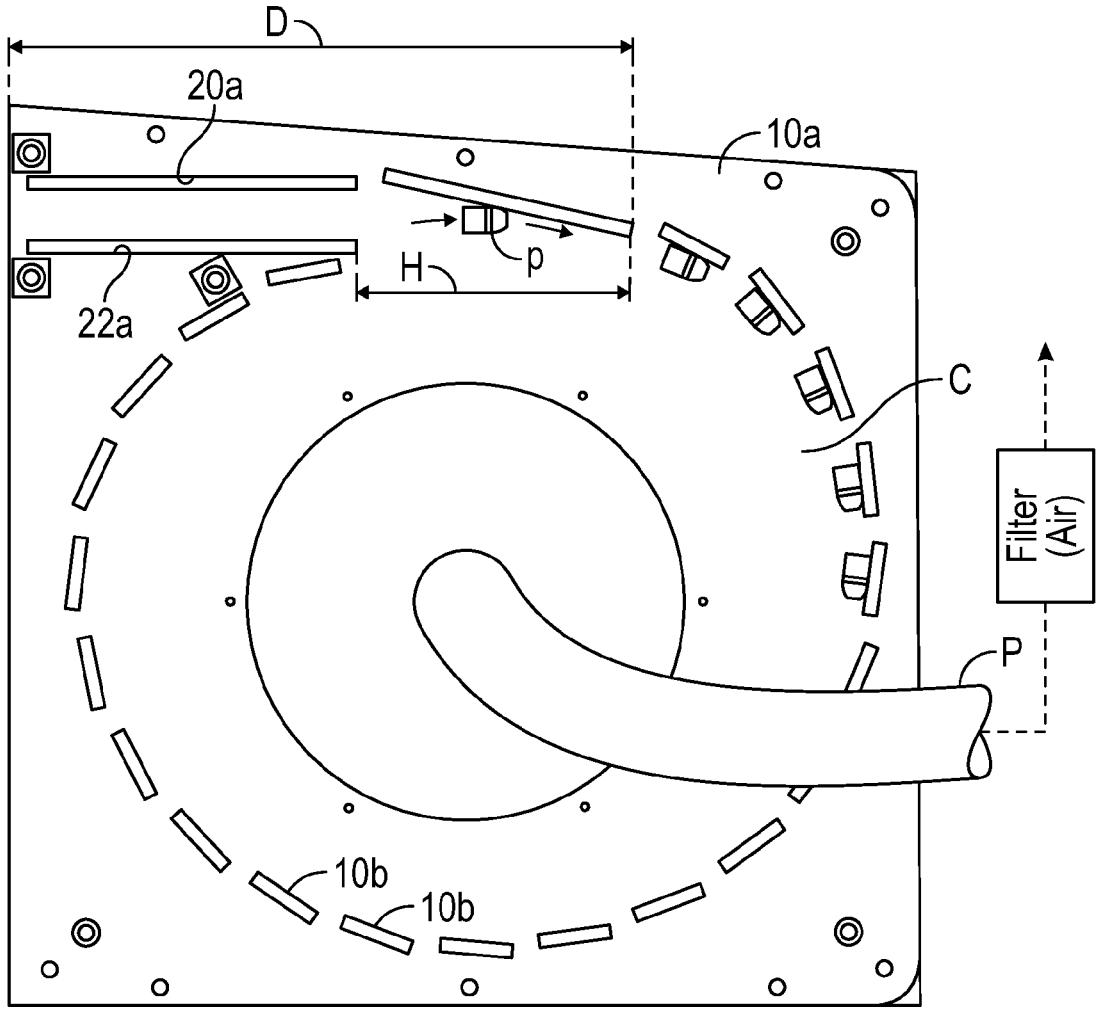
FIG. 4 shows the portion of the top plate defining the vane openings for the vanes which define the containment chamber C and showing additional openings for receiving plates defining the transition passageway D, including the parallel plates plus the impact plate. Also shown are successive positions for a projectile as it is decelerated by changing its direction.
Figure 5:
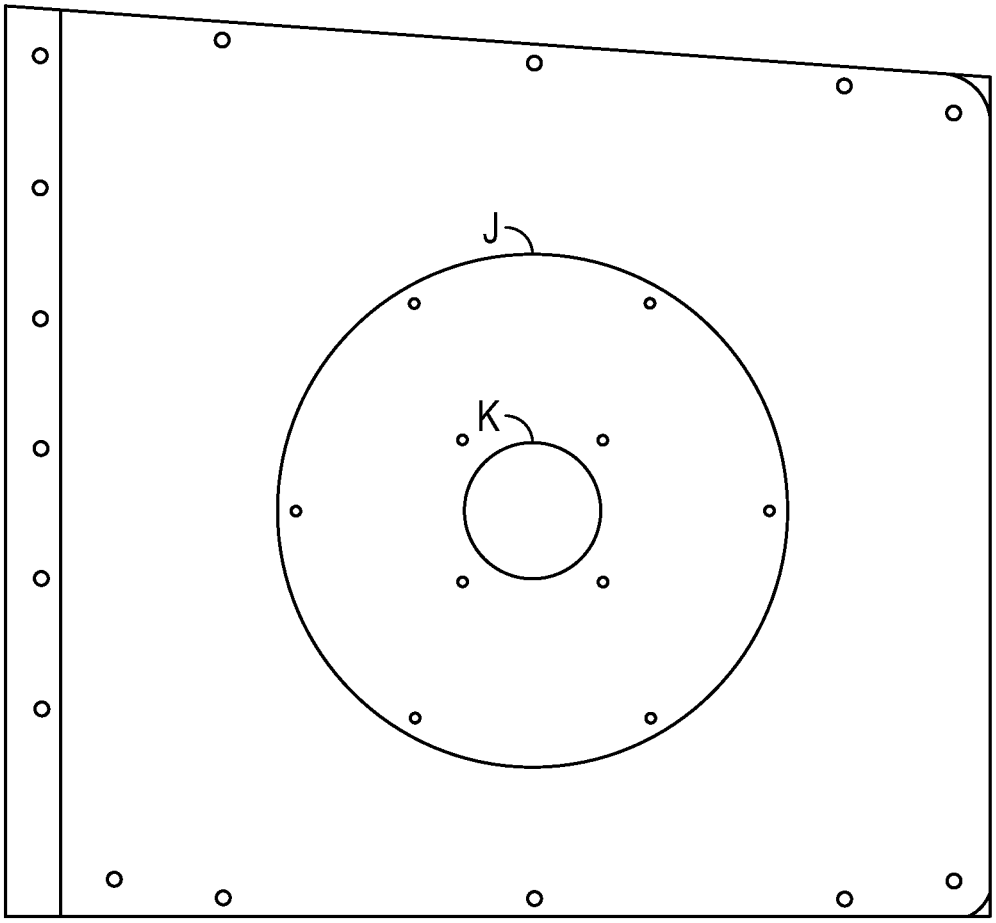
FIG. 5 is shows in plan view the funnel at the lower open end of the containment chamber.
Figure 6A:
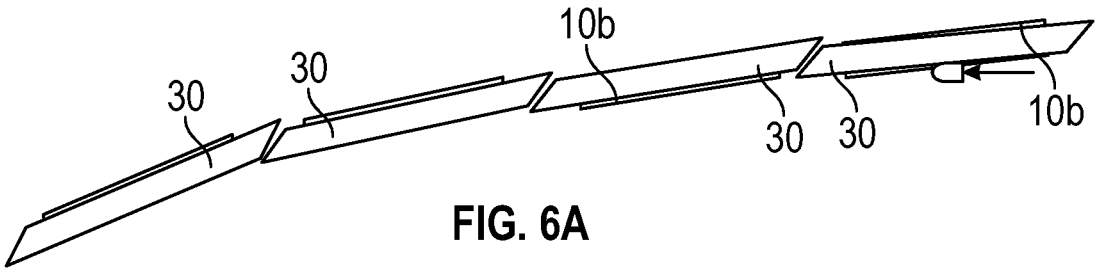
FIGS. 6A, 6B, 6C and 6D show, schematically and sequentially, how the vanes are successively displaced by a bullet striking each vane in turn, during deceleration there of in the containment chamber.
Figure 6B:
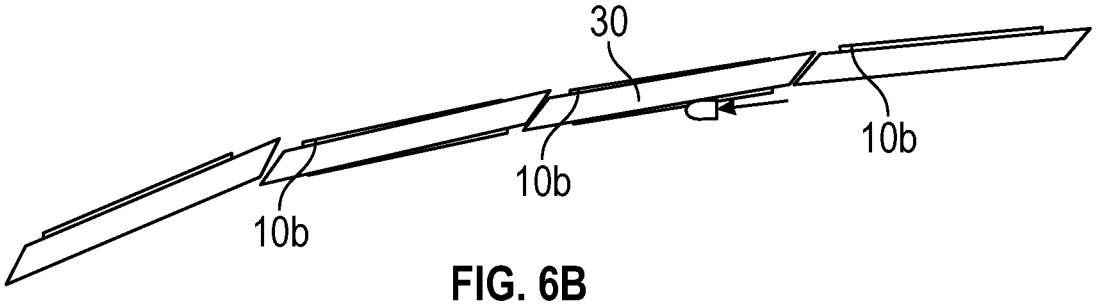
Figure 6C:
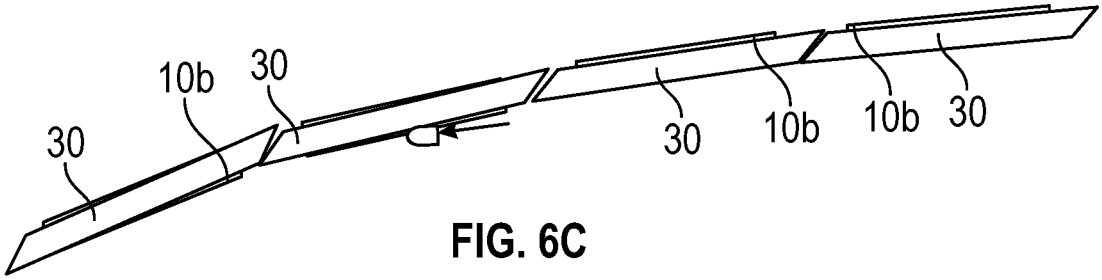
Figure 6D:
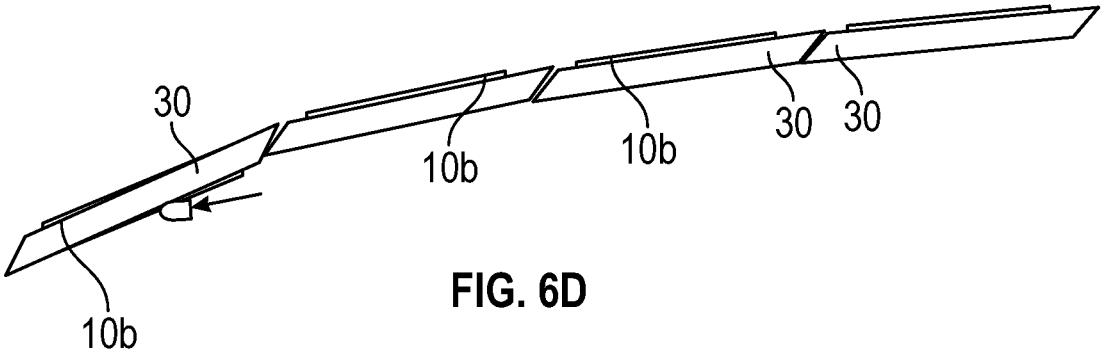
Figure 7:
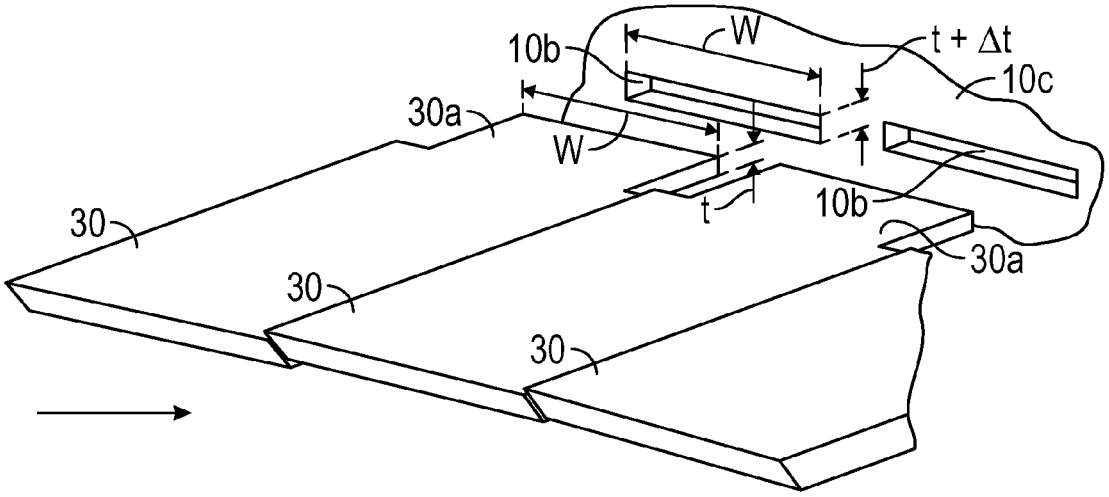
FIG. 7 is an exploded view showing in detail the relationship between the size of the vane end portions and that of the vane openings which loosely mount these vane openings.

The detailed plan views of FIGS. 2 and 4, show the transition passageway D with reference to the containment chamber C of FIG. 1. The slots 20*a*, 22*a* receive parallel plates 20 and 22, respectively, an angled impact plate 24 is arranged opposite to the vertically oriented containment chamber inlet H. These parallel plates 20 and 22 plus the impact plate 24 define the transition zone D. The containment chamber C being defined by the generally cylindrical shape shown for the oversize vane openings (10*b*, 10*b* in FIG. 4 and FIG. 7) that receive individual bullet turning vanes 30, 30 arranged at angles that gradually increase, hence gradually change the direction and speed of the bullets as they are decelerated inside this chamber C. Note that inside the containment chamber these vane angles vary slightly around the arcuate interior, but each vane is generally oriented at an angle in the range of 13-20 degrees relative to an adjacent vane. Thus, the projectile containment chamber C is similar to that described in, prior U.S. Pat. No. 8,827,274 but has its axis oriented vertically rather than horizontally as in the prior version of my invention.

The containment chamber C is provided downstream of the throat area B defined at the downstream edges of the convergent hardened steel plates 16 and 18, and the transition passageway D is provided between the throat area B and the inlet H to the containment chamber C. Whereas the horizontally arranged containment chamber of my earlier patent required access to the interior of the containment chamber through a side opening, the vertically oriented chamber C of the present invention has a tunnel shaped bottom opening J, K for guiding the spent bullet fragments into a waste bucket W below the funnel. This chamber C has a top opening, see FIG. 4, fitted with a pipe P for sucking out the lead laden air, and delivering this toxic air to an air filtration system (not shown) located on, or adjacent, the bullet trap frame.

As shown in FIGS. 6A-6D, the containment chamber vanes have end portions 30*a*,30*a* fitted to top and bottom plates 10*a* in oversize vane openings 10*b* as in my prior '274 patent. The overlapping longitudinal edges of these vanes 30,30 create complementary vane movement. The first vane struck moves slightly due to the greater vane opening width W, than vane thickness, and the overlapping vanes cause complementary movement of at least one adjacent vane. Providing limited vane movement, which is restricted both by the vane opening size and shape and by the overlapping vane edges leads to the results depicted in FIGS. 6A-6D. A third factor effecting vane movement is achieved in this improvement as in my prior patent, by wrapping a compressible elastomeric blanket T around the outside of the vanes, and by applying radially inwardly compressive forces on this blanket by tensioning the elastomeric blanket I as suggested by the broken circumferential line in FIGS. 1 and 2.

The adjacent vanes are thus held in edge to edge contact with one another and biased inwardly of their respective slots as suggested in FIGS. 6*a*-6*d* from prior U.S. Pat. No. 8,827,274. When a vane is struck by a projectile, it twists slightly (as suggested in the FIGS. 6*a*-6*d* sequence of prior U.S. Pat. No. 8,827,274). Each projectile is decelerated both by impacting successive vanes, and by the aforementioned vane edge interaction. The above sequential views show the vane downstream of that vane actually struck, moving even without itself being struck by the projectile, and in an opposite angular direction.

In summary, adjacent turning vanes 30,30 have interacting trailing and leading edges, such that the trailing edge of an upstream vane lies inside the leading edge of a downstream vane. Thus, the vanes are normally biased inwardly, but adjacent vanes will be angularly displaced (oppositely) upon impact by a projectile at even slight angles of attack with the upstream vane. Stated somewhat differently, the vane leading edges define an arc of larger radius than the arc defined by the trailing edges, at least when the vanes are in their normal positions, as dictated by the restraining blanket and being tensioned as suggested in my prior U.S. Pat. No. 8,827,274.

In the preferred embodiment shown, only one impact plate 24 is provided opposite the entry opening H of the containment chamber C, and is oriented at an angle R in the range of 10-15 degrees, preferably 11 degrees relative the downstream direction (as indicated by the parallel plates 20 and 22 in FIG. 2. Furthermore, in the transition zone D between the throat area B and the chamber opening H, these parallel plates 20 and 22 form a continuation of, and bound the same cross sectional area as that of the throat B.

The containment chamber C has a first vane 30*a* so oriented as to define an angle M with the center line F, and as shown in FIG. 2, this angle M=R+17°. Since R is in the range of 10°-15°, M is in the range of 27°-32°, because the 17° angle is measured relative to the angle R of impact plate 24.

What is claimed is:

1. Projectile containment system for trapping bullets therein, and comprising:

A) at least two opposing generally flat hardened steel plates defining a convergent passageway for directing the bullets downstream into a throat area defined by the downstream ends of said two opposing plates, B) a containment chamber, defined by a plurality of hardened steel turning vanes arranged in side by side overlapping relationship to form a generally cylindrically shaped chamber having an inlet opening oriented at a substantial angle to the plane defined by said downstream ends of said hardened steel plates, C) a support frame having top and bottom support plates defining vane openings for loosely receiving end portions of said turning vanes, and vane biasing means acting on said turning vanes to urge at least the majority of said vanes radially inwardly of said containment chamber to impede and turn the bullets entering said chamber inlet opening, D) a transition passageway between said throat area and said containment chamber inlet opening, said transition passageway defined by opposing transition inlet plates forming an extension of said throat area, and at least one impact plate/vane provided downstream of one of said opposing inlet plates and oriented at an angle in the range of 10-15 degrees relative said opposing transition inlet plates, said impact plate has a downstream edge provided adjacent to a first turning vane defining a downstream edge of said chamber inlet opening.

2. The containment system of claim 1 wherein said vane biasing means comprises a compressible elastomeric blanket provided around said vanes to urge said vanes inwardly.

3. The containment system of claim 2 wherein adjacent vanes are overlapping the leading edges define an arc of larger radius than the arc defined by said trailing edges when said vanes are in normal positions, said leading and trailing edges being upstream and downstream relative the direction of the bullet being decelerated.

4. The containment system of claim 1 wherein said transition passageway between said throat area and said containment chamber inlet opening, is bounded by projectile guiding generally parallel plates forming a continuation of said throat area, and said impact plate is oriented opposite the inlet opening of said containment chamber at an angle of approximately 12° relative a center line defined by said opposing transition inlet plates.

5. The containment chamber of claim 1 wherein said generally cylindrical containment chamber has a central axis oriented generally vertically, and said cylindrical chamber having a bottom opening through which spent projectile fragments fall downwardly out of said chamber.

6. The containment chamber of claim 5 wherein said cylindrical chamber has a top opening, and suctioning means coupled to said containment chamber top opening for withdrawing air and air entrained particles from said chamber.

7. The containment system of claim 1 further characterized by said transition passageway between said throat area and said containment chamber inlet opening more particularly defined by opposing projectile guiding generally parallel plates that together form a continuation of said throat area, and a single impact plate opposite the entry opening into said containment chamber.

8. The containment system of claim 7, wherein each vane has marginal edges overlapping a marginal edge of at least one adjacent vane, whereby tilting movement of one vane causes tilting movement of that adjacent vane.

9. The containment system of claim 1 further characterized by said opposing hardened steel plates defining said convergent passageway loosely mounted in openings defined by frame support plates, and elastomeric pads provided adjacent to projecting tabs defined by side edges of said opposing hardened steel plates, said frame support plate openings fitted with flanges abutting said elastomeric pads.

10. The containment system of claim 9 wherein said frame support plates fitted with said flanges comprise non hardened steel and define opposing sides of said convergent passageway, and said support plates also being inclined inwardly to form a rectangular shape for said throat area, the longer sides of which rectangular throat area being defined by said hardened steel plates, the shorter sides being defined by said non hardened steel support plates.

* * * * *